United States Patent [19]

Minick

[11] Patent Number: 4,519,754

[45] Date of Patent: May 28, 1985

[54] PERISTALTIC PUMP HAVING VARIABLE OCCLUSION RATES

[76] Inventor: Dale E. Minick, Rte. 2, Box 337, Rapid City, Mich. 49676

[21] Appl. No.: 552,760

[22] Filed: Nov. 17, 1983

Related U.S. Application Data

[63] Continuation of Ser. No. 306,667, Sep. 29, 1981, abandoned.

[51] Int. Cl.[3] ..... F04B 43/12

[52] U.S. Cl. ..... 417/477

[58] Field of Search ..... 417/475, 476, 477

[56] References Cited

U.S. PATENT DOCUMENTS 4,138,205 2/1979 Wallach ..... 417/477 X 4,189,286 2/1980 Murry et al. ..... 417/477

FOREIGN PATENT DOCUMENTS 2812805 10/1978 Fed. Rep. of Germany ..... 417/477

*Primary Examiner*—Richard E. Gluck

*Attorney, Agent, or Firm*—Carothers & Carothers

[57] ABSTRACT

A peristaltic pump of the type having a housing, a rotor mounted on the housing and adapted for rotation about its longitudinal axis and carrying at least two compression rollers for movement in a circular path, a reaction member mounted on the housing and having a reaction surface adapted to at least partially encircle the circular path traversed by the compression rollers, and a compressible tube interposed between the rotor and reaction surface so that the compression rollers effect a peristaltic pumping action on the tube during rotation. The reaction member preferably extends approximately 270 degrees about the circular path of the compression rollers and is mounted on the housing through cam control means which enables adjustment of the reaction surface between a position concentric with the rotor and positions eccentric to the circular path of the rollers so as to effect variation in the rate of occlusion of the tube in a manner to obtain reduced thermal degradation of the tube and thereby prolong tube life.

5 Claims, 5 Drawing Figures

2
2
3
3
70
70
50
44
40a
14
60
45
45
76
54b
52b
32b
52
32a
26
30b
18
56
58
36a
36
32c
30a
24
52a
74
30c
54a
36c
45
36d
42
38

16
18
40
14
68a
68b
24
22
36b
56
36c
52a
36
52b
36a
52
30b
70
70
50
40a
60

70
F
14
B
30b
44
36
30a
40a
26
18
36a
56
24
30c
A
42
38

PERISTALTIC PUMP HAVING VARIABLE OCCLUSION RATES

This is a continuation of application Ser. No. 306,667, filed Sept. 29, 1981, now abandoned.

BACKGROUND OF THE INVENTION

The present invention relates generally to peristaltic pumps, and more particularly to a novel peristaltic pump having means for varying the occlusion rates of a compressible flow tube so as to optimize tube life.

Fluid flow pumps of the peristaltic type wherein moving regions of occlusion are effected on a compressible flow tube by rollers or thrust elements carried by a rotor are generally known. See, for example, U.S. Pat. No. 3,358,609 to Worth et al. Such pumps generally have reaction surfaces formed either intergral with the housing or on a separate housing or reaction member mounted such that the reaction surface lies in the plane of the circular path traversed by the compression rollers. In the operating mode, the reaction surface is substantially concentric with the circular path traversed by the compression rollers, and has an arcuate extent of substantially less than 360 degrees. The compressible flow tube is disposed between the reaction surface and the rotor so that the compression rollers compress or occlude the tube as they traverse their circular paths so as to create a peristaltic pumping action.

The flow rate of a peristaltic pump is a function of the rotor speed and the total volume of the occluded portion of the compressible flow tube. Thus, for a given pump having a predetermined compressible flow tube size and rotor speed, it is desirable that the compressible tube encompass or encircle as much of the 360 degree path traversed by the compression rollers as possible to achieve maximum flow capacity. While maximum flow is highly desirable, the overall efficiency of the pump, in terms of service life and operating costs in comparison to other types of pumps, is, in major part, a function of the life of the compressible tube. The service life of compressible tubes employed in peristaltic pumps of known prior design has been relatively short, requiring frequent replacement or maintenance as compared to maintenance intervals required for the operation of other types of pumps. Further, failure to adhere to a relatively stringent maintenance schedule frequently results in failure of the compressible tube, thus resulting in product loss. The maintenance requirements and risk of product loss should the operator fail to maintain a rigid maintenance schedule have been a deterrent to the wider adoption and use of peristaltic type pumps.

Another deterrent to the wider adoption of peristaltic type pumps is the relatively high cost of compressible tubes which are compatible with peristaltic pumps. The service life of a compressible tube employed in a peristaltic pump has been found to be inversely proportional to the amount of occlusion during a pumping mode, while pump performance in terms of the ability to develop pressure and vacuum, but not flow, has been found to be directly proportional to the amount of tube occlusion. It has thus been necessary in the design of peristaltic pumps to compromise tube life for the sake of pump performance.

The fixed occlusion rate of known peristaltic pumps also requires that the wall thickness of the compressible tubes be precise and consistent since the occlusion rate is dependent upon the combined wall thickness of the tube. For a given peristaltic pump, pump performance decreases when the wall thickness of the compressible tube is thinner than that which results in optimum performance, while tube life decreases with compressible tubes having greater wall thicknesses. Although compressible tubes having precise and consistent wall thickness result in more efficient pump operation, such tubes are more expensive than compressible tubes having variable wall thickness.

It has also been found that the tube life of a compressible tube employed in a peristaltic type pump is effected by a phenomenon wherein heat generated by compression or occlusion of the tube material tends to migrate in the direction of rotation of the thrust or compression rollers carried by the rotor. It has been found that a "hot spot" develops at the point on the tube where the compression rollers begin to release occlusion resulting in thermal degradation of a small area of the occluded section of the tube. If the hot spot is induced to reside or build up in a longer portion of the compressible tube, a corresponding decrease in maximum temperature results and thermal degradation is substantially decreased resulting in an increase in tube service life.

SUMMARY OF THE INVENTION

In accordance with the present invention, a peristaltic pump is provided having a housing on which is mounted a rotor adapted to be rotated about its longitudinal axis by a drive motor or the like. The rotor carries a plurality of compression rollers for movement in a circular path during rotation of the rotor. A reaction member is mounted on the housing and has a uniform radius reaction surface adapted to partially encircle the circular path traversed by the compression rollers. A compressible flow tube is interposed between the rotor and the reaction surface and is adapted to be occluded by the compression rollers. The reaction member preferably defines a reaction surface which encircles approximately 270 degrees of the circular path traversed by the compression rollers and is mounted on the housing for pivotal movement about a fixed pivot axis in the plane of travel of the compression rollers. The reaction member has cam control means operatively associated therewith which enables adjustment of the reaction member between a position wherein the reaction surface is substantially concentric with the circular path traversed by the rollers and positions wherein the reaction surface is eccentric to the circular path so as to enable selective variation in the rate of occlusion of the tube by the compression rollers. In this manner, the rate of occlusion of the compressible tube and a controlled gradual progressive release of occlusion may be effected to reduce thermal degradation of the compressible tube and increase tube life.

Accordingly, a general object of the present invention is to provide a novel peristaltic pump having means for varying the rate of occlusion of the associated compressible tube in a manner to provide substantially improved tube life.

A more particular object of the present invention is to provide a novel peristaltic type pump which facilitates the use of compressible tubes having a substantially greater range of wall thicknesses than are possible with known peristaltic pumps, without decreasing pump efficiency or tube life.

Another object of the present invention is to provide a novel peristaltic type pump having a reaction member defining a reaction surface cooperative with one or more thrust or compression rollers to affect a peristaltic pumping action on a compressible tube, the reaction member having operative association with cam control means enabling an operator to selectively adjust the rate of occlusion of the tube so at to obtain optimum tube life.

A feature of the peristaltic pump in accordance with the present invention lies in the provision of a substantially C-shaped reaction member having a reaction surface of substantially constant radius concentric with the circular path traversed by the compression rollers during loading of a compressible tube into the pump, the reaction member being mounted on the pump housing for pivotal movement in the plane of travel of the compression rollers and encircling the circular path of the compression rollers approximately 270 degrees, the reaction member further having cam control means operative therewith to move the reaction surface to a selective position eccentric to the circular path traversed by the compression rollers so as to vary the rate of occlusion of the compressible tube.

Further objects and advantages of the present invention, together with the organization and the manner of operation thereof, will become apparent from the following detailed description of the invention when taken in conjunction with the accompanying drawings wherein like reference numerals designate like elements throughout the several views.

DETAILED DESCRIPTION OF THE INVENTION

Figure 1:
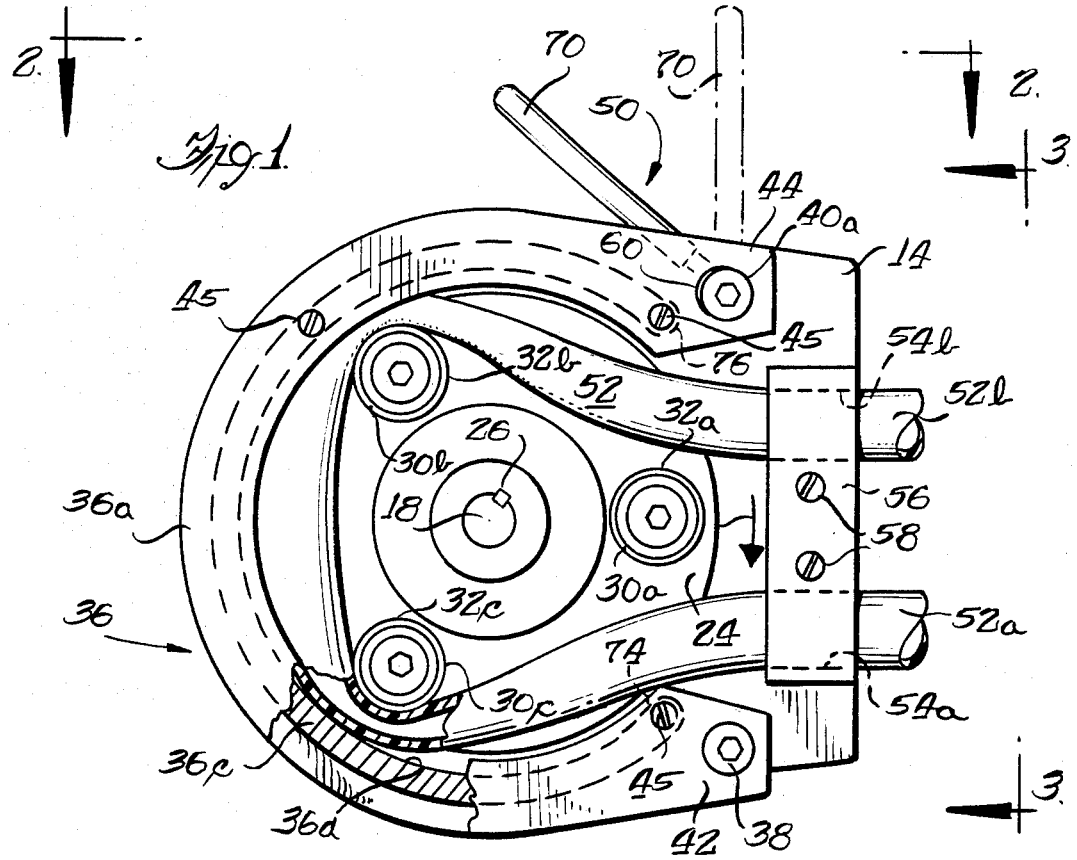
FIG. 1 is a front elevational view of a peristaltic pump constructed in accordance with the present invention.
Figure 2:
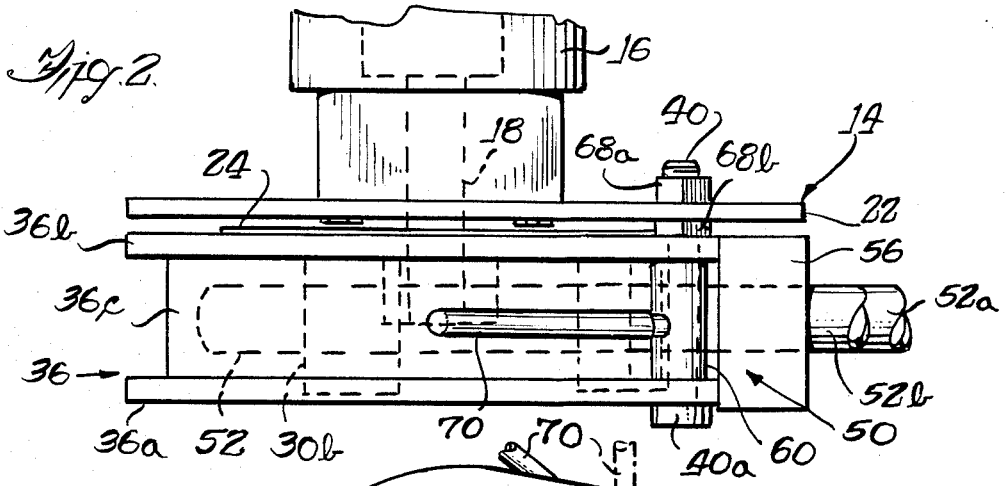
FIG. 2 is a fragmentary top plan view of the peristaltic pump of FIG. 1, taken substantially along the line 2—2 of FIG. 1 and looking in the direction of the arrows.
Figure 3:
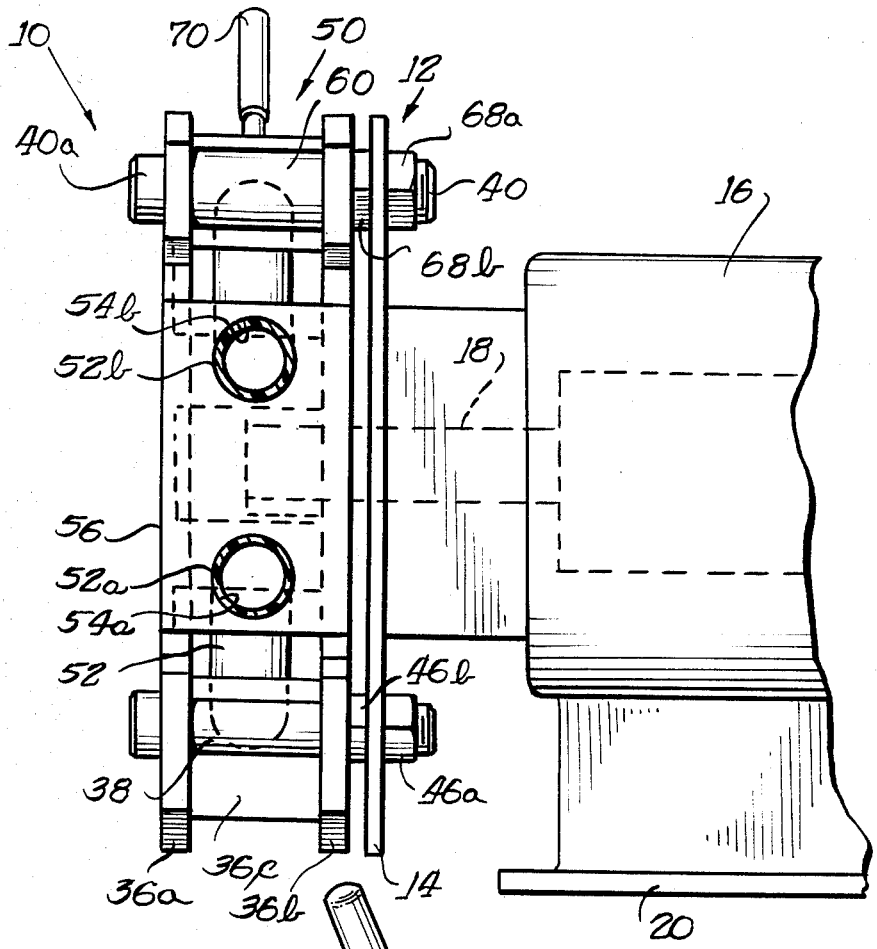
FIG. 3 is a fragmentary side elevational view of the peristaltic pump of FIG. 1, taken substantially along line 3—3 of FIG. 1 and looking in the direction of the arrows.

Referring now to the drawings, and in particular to FIGS. 1–3, a peristaltic pump constructed in accordance with the present invention is indicated generally at 10. The peristaltic pump 10 includes housing means, indicated generally at 12, which, in the illustrated embodiment, takes the form of a planar base plate 14. The base plate 14 is mounted on a suitable drive motor, such as an electric motor 16, so that the base plate lies in a plane normal to a drive shaft 18 which forms a part of the drive motor 16 and is thereby adapted to be rotationally driven about its longitudinal axis. The motor 16 has a mounting base 20 which facilitates mounting of the drive motor and associated peristaltic pump on a suitable support surface or the like.

The motor drive shaft 18 extends through a suitable opening generally centrally of the base plate 14 and has a circular generally planar rotor 24 fixed on the outer end thereof for rotation therewith, such as through a slot-key arrangement as indicated at 26. The rotor 24 carries a plurality of compression or thrust rollers which, in the illustrated embodiment, comprise three compression rollers 30*a*, 30*b* and 30*c*. The compression rollers 30*a*, *b* and *c* are of conventional design and are mounted on the rotor 24 so that their rotational axes are normal to the rotor and lie in equidistantly circumferentially spaced relation about a common circle concentric with the axis of drive shaft 18. In this manner, each of the compression or thrust rollers 30*a*, *b* and *c* traverses a circular path during each revolution of the rotor. The rollers 30*a*, *b* and *c* preferably comprise bearing mounted annular rollers having outer peripheral compression surfaces 32*a*, 32*b* and 32*c*, respectively. It will be appreciated that while the rotor 24 is illustrated as having three compression rollers mounted thereon, more than three compression rollers may be employed if desired.

A reaction member, indicated generally at 36, is mounted on the base plate 14 through a pair of set screws 38 and 40 which are releasibly connected to the base plate 14 in normal relation thereto. In the illustrated embodiment, the reaction member 36, which may alternatively be termed a reaction housing, is generally C-shaped, as viewed in FIG. 1, so as to partially encircle rotor 24 and define a pair of terminal ends 42 and 44. The reaction member 36 may be formed integral or may have laterally spaced substantially identically shaped side plates 36*a* and 36*b* connected to an arcuate reaction plate 36*c*, as through screws 45. The mounting screw 38 extends through suitable bores through the terminal end 42 of the reaction member 36 so as to enable pivotal movement of the reaction member about the axis of the mounting screw 38 in a plane substantially coplanar with the circular path traversed by the rollers 30*a*, *b* and *c* on the rotor 24. To this end, the mounting screw 38 is fixed to the base plate 14 through suitable means such as a pair of nuts 46*a* and 46*b*. Alternatively, a threaded bore could be provided in the base plate 14 to provide a direct threaded connection with the mounting screw 38.

As will be described in greater detail hereinbelow, the terminal end 44 of the reaction member 36 is connected to the base plate 14 through cam control means, indicated generally at 50, which has cooperation with the reaction member and the base plate so as to enable selective adjustment of the reaction member relative to the rotor 24 and compression rollers 30*a–c* carried thereon. The reaction member 36 has a reaction surface 36*d* formed thereon of a uniform radius greater than the radius of a cylindrical envelope defined by the outermost surfaces of the compression roller 30*a–c* as they traverse their circular paths. The reaction member 36 is mounted on the base plate 14 for movement through adjustment of the cam control means 50 between a position wherein the reaction surface 36*d* is concentric with the circular path traversed by the rollers 30*a–c* and positions wherein the reaction surface is eccentric to the circular path traversed by the compression rollers.

A compressible tubular flow tube 52 is supported on the base plate 14 of peristaltic pump 10 so that a continuous length of the compressible tube is interposed between the compression rollers 30*a–c* and the reaction surface 36*d* of the reaction member 36. The compressible tube 52 may be mounted on the base plate 14 in any suitable manner so as to establish a loop about the compression rollers 30*a–c* and substantially prevent longitudinal creeping of the tube during a pumping operation. In the illustrated embodiment, the compressible tube 52 has end or intermediate length portions 52*a* and 52*b* which may be defined as entry and exit portions, respectively, of the compressible tube and which are received through suitable parallel bores 54*a* and 54*b*, respectively, formed in a retainer block 56 mounted on the base plate 14 through screws 58. The bores 54*a* and 54*b* are preferably of a diameter slightly less than the outer diameter of the tube 52 so as to enable insertion of the compressible tube through the bores but frictionally restrain the tube against longitudinal creeping, as is known. The retainer block 56 may be of any known design such as a mutually cooperable two piece design having a releasible cap portion enabling the compressible tube to be laid into two semi-cylindrical bore halves after which the releasible cap is re-attached to fix the tube in place.

The compression tube 52 may be made of any suitable material, such as a suitable plastic, which lends itself to use in a peristaltic type pump. A compressible tube 52 is selected having an outer diameter and radial wall thickness such that for a given diameter circular path traversed by rollers 30*a–c*, and a given reaction surface 36*d*, the compressible tube will not be fully compressed or occluded by the compression rollers when the reaction surface 36*d* is concentric with the circular path traversed by the compression rollers, as shown in FIG. 1.

Figure 5:
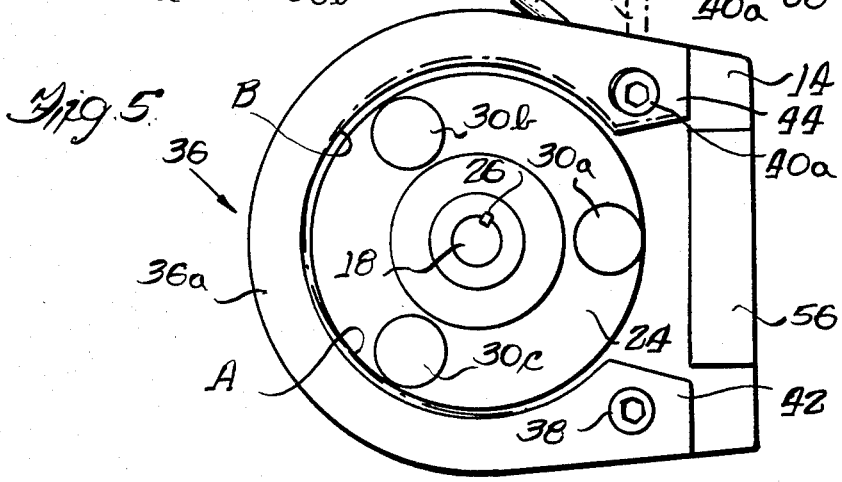
FIG. 5 is a partial front elevational view of the peristaltic pump of FIG. 1, but with the compressible tube removed and with the reaction member being shown in solid lines in a position wherein the reaction surface is concentric with the rotor and being shown in phantom lines in a position wherein the reaction surface is eccentric to the rotor.
Figure 4:
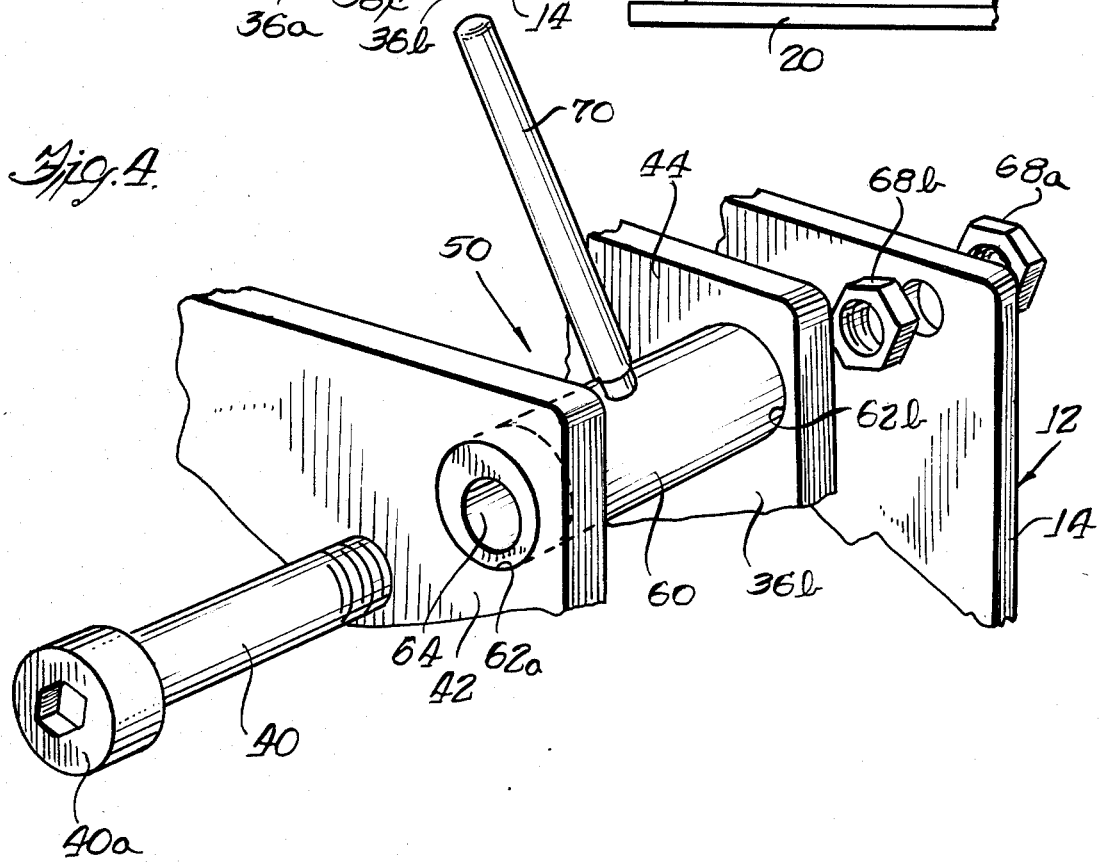
FIG. 4 is a fragmentary exploded view, on an enlarged scale, illustrating the cam control for the reaction member on the peristaltic pump illustrated in FIGS. 1–3.

Referring particularly to FIG. 4, taken in conjunction with FIGS. 3 and 5, the cam control means 50 includes a cylindrical cam member 60 which has its opposite ends rotatably received within suitable axially aligned bores 62*a* and 62*b* formed, respectively, in the side plates 36*a* and 36*b* of the reaction member 36. The cam member 60 has a cylindrical bore 64 formed therethrough the longitudinal axis of which is parallel to and spaced from the longitudinal axis of the cylindrical cam member. The bore 64 is sized to receive the set screw 40 therethrough so that when the set screw 40 is secured to the base plate 14, as through nut 68*a* and 68*b*, the cylindrical cam member 60 is slidably rotatable about the shank of the set screw 40. In this manner, the cylindrical cam member 60 serves as a cam control which, upon rotation of the cam member about the axis of the set screw 40, serves as a cam to move to the reaction member 36 about its pivot axis 38. The cylindrical bore surfaces 62*a* and 62*b* serve as cam follower surfaces.

To facilitate selective manual rotation in the cam member 60 about its eccentric axis of rotation 40, a lever or handle 70 is affixed to the cam member 60 at its mid-length so as to extend substantially radially from the cylindrical cam member. The head 40*a* of the set screw 40 is preferably of sufficient diameter that it at least partially overlies the side plate 36*a* of reaction member 36 adjacent the bore 62*a* therethrough. In this manner, the set screw 40 may be tightened to lock the cam member 60 in a selected rotational position relative to base plate 14 and also retain the terminal end 44 of the reaction member 36 on the cam member.

In the operation of the peristaltic pump 10, and assuming that the compressible tube 52 has not been assembled into the pump, the set screws 38 and 40 may be removed from the base plate 14 and at least partially withdrawn from the terminal ends 32 and 44 of the reaction member 36. This releases the reaction member from the base plate 14 and allows it to be readily removed from the area of the rotor 24.

With the reaction member 36 removed from the mounting plate 14, the compressible hose 52 may be inserted longitudinally through the bores 54*a* and 54*b* in the retaining block 56 and looped about the compression rollers carried on the rotor 24, as illustrated in FIG. 1. With the compressible tube thus mounted, the reaction member 36 is inserted over the compression rollers and associated compressible tube, such as by movement of the reaction member in a direction generally axially of the rotor, whereafter the mounting screws 38 and 40 are inserted through the terminal ends 42 and 44 of the reaction member and secured to the base plate 14. A cover plate (not shown), such as a transparent plastic plate, is preferably secured to the outer surface of the side plate 36*a* of the reaction member 36 so as to substantially cover the area of the rotor and compression roller to prevent inadvertent insertion of fingers or other objects into the rotor area during a pumping operation.

The lever 70 is mounted on the cam member 60 so that with the lever 70 in a position as shown in solid lines in FIGS. 1 and 5, the reaction surface 36*d* on the reaction member 36 extends around substantially 270 degrees of the circular path traversed by the compression rollers 30*a–c* in concentric relation therewith. As aforenoted, in this position, the compression rollers 30*a–c* are incapable of fully compressing or occluding the compressible tube 52 during rotation of the rotor 24. In this condition, the pump 10 may be employed to pass fluid through the hose 52 from the inlet end 52*a* to the outlet end 52*b*. However, very little suction is created at the inlet end of the compressible flow tube so that, depending on the viscosity of the fluid being pumped, the pump is incapable of overcoming a substantial pressure head such as might exist should the source of fluid to be pumped be at a substantially lower elevation than the pump 10.

With the control cam member 60 positioned such that the reaction surface 36*d* is concentric with the circular path traversed by the compression rollers 30*a–c*, the operator may connect a vacuum gauge to the inlet end 52*a* of the compressible tube 52 and energize the pump drive motor to rotate the rotor and associated compression rollers. It will be understood that the inlet and outlet 52*a* and 52*b* of the compressible tube 52 may have suitable fittings secured thereon to facilitate connection to another length of the flow tube such as a flow tube which does not have the desired compressibility characteristics of the tube 52. Such a fitting on the inlet end of tube 52 could also facilitate connection of a vacuum gauge to the inlet end.

With the pump operating and having a vacuum gauge connected thereto as aforementioned, the operator may progressively move the control cam member 60 about its eccentric axis 40 by means of lever 70 such that the reaction surface 36*d* is eccentric to the circular path traversed by the compression rollers 30*a–c*. As the operator adjusts the cam control means 50 to move the reaction surface 36*d* to an eccentric position relative to the rotor 24, the compressible tube 52 undergoes greater occlusion or compression so as to indicate an increased vacuum reading on the vacuum gauge attached to the inlet end 52*a* of tube 52. With particular reference to FIG. 5, and assuming that the reaction surface 36*d* encircles the circular path of the compression rollers approximately 270 degrees, maximum occlusion of the compressible tube will occur at a point, indicated at A, which is approximately 90 arcuate degrees from the point at which a given compression roller is radially opposite an entry end 74 of the reaction surface 36*d*. Continued rotation of the control cam member 60, by moving the lever 70 toward a generally upstanding position, as shown in phantom in FIGS. 1 and 5, serves to progressively increase the eccentricity of the reaction surface 36*d* relative to the circular path traversed by rollers 30*a–c* so as to progressively increase the extent of occlusion effected by the compression rollers 30*a–c* on the compressible tube 52.

When the operator reaches a point at which a desired suction is obtained at the inlet end 52*a* of the compressible tube, he tightens down the set screw 40 to lock the control cam member in its adjusted position. This enables the pump to obtain a predetermined suction at the inlet end of the compressible tube without compressing the tube more than required to obtain the desired pumping action. The cam member 60 preferably has sufficient eccentricity relative to axis 40 so that when the control cam member is adjusted to obtain maximum suction at the tube inlet end 52*a* for a given rotor speed, the compression rollers 30*a–c* compress the walls of the flow tube 52 slightly more than the point at which internal surface contact is made, such condition being generally termed over-occlusion.

It will thus be appreciated that the cam control means 50 is adjustable to move the reaction member 36 about its pivotal axis 38 to a position wherein the reaction surface 36*d* is eccentric to the circular path traversed by the compression rollers so as to establish during each revolution of the compression rollers a first substantially 90 degree arcuate region of progressively increasing occlusion which extends from the entry end 74 of the reaction surface 36*d* to the point A indicated in FIG. 5, a second substantially 90 degree arcuate region of progressively decreasing occlusion from point A of maximum occlusion to a point indicated at B in FIG. 5 of reduced occlusion, followed by a third substantially 90 degree arcuate region from point B to an exit end 76 of the reaction surface 36*d* during which occlusion of the tube is reduced to almost zero. It has been found that by adjusting the eccentricity of the reaction surface 36*d* relative to the circular path traversed by the compression rollers 30*a–c* to provide for gradual progressive compression or occlusion of the tube 52 by the compression rollers and gradual progressive release of occlusion in the aforementioned regions about the reaction surface 36*d*, the migrating heat of compression created in the wall of the compressible tube is distributed over a longer region of the occluded portion of the tube. This results in reduction in thermal degradation of the tube due to high temperatures and provides significantly increased tube life. The ability to adjust the rate of occlusion of the compressible tube in the peristaltic pump 10 also enables usage of tubes having different wall thicknesses to achieve predetermined pumping characteristics. This eliminates the need for compressible tubing having precise consistent wall thickness which, as noted, is substantially more expensive than tubing of less precise tolerances.

While a preferred embodiment of the invention has been illustrated and described, it will be understood to that changes and modifications may be made therein without departing from the invention in its broader aspects. Various features of the invention are defined in the following claims.

What is claimed is:

1. A peristaltic pump having a fixed variable occlusion path and adapted to selectively vary the occlusion rate to cause dissipation of heat due to tube deformation stresses comprising:

a housing;

a rotor mounted on said housing and adapted for rotation about its longitudinal axis, at least three compression rollers carried by said rotor for movement in a circular path during rotation of said rotor, a reaction member mounted on said housing and having a reaction surface of substantial uniform radius adapted to partially encircle about 270° of the circular path traveled by said at least three compression rollers, a compressible flow tube interposed between said rotor and said reaction surface and adapted to be occluded by said compression rollers during movement through said circular path, said tube having an inlet end and having an outlet end from which the fluid flows;

pivot means for pivotally mounting one terminal end of the reaction member to the housing at a fixed pivot axis for pivotal movement about the fixed axis adjacent the inlet end of the flow tube;

cam means connected to opposite reaction member terminal end and being adjustable to move the reaction surface of the reaction member about the pivot means toward the compression rollers to cause a progressively increasing occlusion of the tube from the beginning of the reaction surface in a first zone of approximately 90° to a fixed point of maximum occlusion, a second zone of decreasing occlusion extending from the fixed point of maximum occlusion through a central portion of the reaction member, and a third zone decreasing to substantially zero occlusion extending to the outlet end of the reaction member;

said cam means and said pivot means being releasably mounted on said housing to permit axial removal of the reaction member relative to the rotor to permit tube replacement.

2. A peristaltic pump in accordance with claim 1 in which the progressive occlusions occur for approximately 90° and being followed by the second zone of approximately 90° of progressively decreasing tube occlusion, followed by a third zone in which occlusion of said tube is progressively reduced to zero at the end of the reaction surface at the opposite reaction member terminal end.

3. A peristaltic pump in accordance with claim 1 in which said pivot means comprises a removable pivot pin connecting the reaction member to the housing and in which the cam means includes a removable pin connecting the reaction member to the housing, loosening of the pins allowing removal of the reaction member in a horizontal direction from the compression rollers and from the flow tube extending about the compression rollers.

4. A peristaltic pump in accordance with claim 1 in which the cam means includes a handle for grasping and turning to change the occlusion rate by shifting cam means to swing the reaction member about the fixed axis at the inlet end of the reaction member.

5. A peristaltic pump having a variable occlusion path to dissipate heat due to tube occlusion stresses comprising:

a housing;

a rotor mounted on said housing and adapted for rotation about its longitudinal axis, at least three compression rollers carried by said rotor for movement in a circular path during rotation of said rotor, a unitary reaction member mounted on said housing for swinging about a pivot axis and having a reaction surface of substantial uniform radius adapted to at least partially encircle the circular path traveled by said at least three compression rollers, a fixed pivot means pivotally mounting the reaction member at one end adjacent an inlet side of the pump and defining the pivot axis and variable occlusion path for the reaction member, a compressible flow tube interposed between said rotor and said reaction surface and adapted to be partially occluded by said compression rollers during movement through said circular path and means including cam control means mounting said reaction member on said housing and being adjustable to move said reaction member between a starting position wherein said reaction surface is substantially concentric with said circular path and a position wherein said reaction surface is eccentric to said circular path so as to enable selective variation in the occlusion rate of said tube by said compression rollers as they traverse said circular path, said reaction surface extending about said rotor so as to encircle approximately 270° of the circular path traversed by said rollers, said reaction surface cooperating with said compressible tube and said compression rollers to define an arcuate region of partial occlusion of said tube during each revolution of said compression rollers with said reaction surface concentric with said circular path, said control means being operative to move said reaction member about its pivot axis to a position wherein said reaction surface is eccentric to said circular path and establishes during each revolution of said compression rollers a first arcuate region of approximately 90° of progressively increasing occlusions to a fixed point of maximum occlusion approximately 90° from the inlet portion of the flow tube, followed by a second arcuate region of approximately 90° of progressively decreasing occlusions followed by a third arcuate region of approximately 90° in which occlusion of said tube is progressively reduced to zero adjacent the outlet portion of the flow tube said cam control means including a lever handle mounted to turn the cam means with movement of the lever handle to swing the reaction member about its fixed axis and to vary the occlusion rate of the tube.

* * * * *